US012631409B2

(12) United States Patent
Seyed Ahmadi et al.

(10) Patent No.: US 12,631,409 B2
(45) Date of Patent: May 19, 2026

(54) HEAT EXCHANGER BAFFLES AND METHODS FOR MANUFACTURING THE SAME

(71) Applicant: Bradford White Corporation, Ambler, PA (US)

(72) Inventors: Mehran Seyed Ahmadi, Holt, MI (US); Bruce Hill, Middleville, MI (US)

(73) Assignee: Bradford White Corporation, Ambler, PA (US)

( * ) Notice: Subject to any disclaimer, the term of this patent is extended or adjusted under 35 U.S.C. 154(b) by 1042 days.

(21) Appl. No.: 17/626,892

(22) PCT Filed: Jul. 15, 2020

(86) PCT No.: PCT/US2020/042096

§ 371 (c)(1),
(2) Date: Jan. 13, 2022

(87) PCT Pub. No.: WO2021/011627

PCT Pub. Date: Jan. 21, 2021

(65) Prior Publication Data

US 2022/0260326 A1 Aug. 18, 2022

Related U.S. Application Data

(60) Provisional application No. 62/874,574, filed on Jul. 16, 2019.

(51) Int. Cl.
*F28F 13/12* (2006.01)
*F22B 37/06* (2006.01)
(Continued)

(52) U.S. Cl.
CPC ..... *F28F 13/12* (2013.01); *F22B 37/06* (2013.01); *F22D 1/24* (2013.01); *F24H 9/0026* (2013.01);
(Continued)

(58) Field of Classification Search
CPC . F22B 37/06; F22D 1/24; F24H 1/205; F24H 9/0026; F28D 21/0007;
(Continued)

(56) References Cited

U.S. PATENT DOCUMENTS 3,595,299 A * 7/1971 Pullach ..... F17C 9/02 165/157
5,006,246 A * 4/1991 Edwards ..... B01J 47/022 210/264
(Continued)

FOREIGN PATENT DOCUMENTS

CN 104613805 A 5/2015
CN 108561992 A 9/2018
(Continued)

OTHER PUBLICATIONS

International Search Report and Written Opinion for International Application No. PCT/US2020/042096, dated Oct. 26, 2020, 9 pages.
(Continued)

*Primary Examiner* — Steven B McAllister
*Assistant Examiner* — Benjamin W Johnson
(74) *Attorney, Agent, or Firm* — Willard Quinn PLLC

(57) ABSTRACT

Water heaters, baffles for water heaters, and methods for manufacturing such baffles are disclosed. One baffle includes a core, an outer wall, and a plurality of fins. The outer wall surrounds the core and defines at least one flow path between the outer wall and the core. The plurality of fins extend from the outer wall toward the core. Each of the plurality of fins has a serpentine shape. One method for manufacturing a baffle includes extruding at least one portion of the baffle in one piece, the at least one portion of the baffle having an at least partially cylindrical outer wall and a plurality of fins extending inward from the outer wall, each
(Continued)

of the plurality of fins having a serpentine shape. One water heating system includes a burner, a vent, at least one flue tube, and at least one baffle as described above.

23 Claims, 12 Drawing Sheets

(51) Int. Cl.

| | |
|---|---|
| ***F22D 1/24*** | (2006.01) |
| ***F24H 9/00*** | (2022.01) |
| ***F28D 21/00*** | (2006.01) |
| ***F28F 1/40*** | (2006.01) |
| *F24H 1/20* | (2022.01) |

(52) U.S. Cl.
CPC ..... *F28D 21/0007* (2013.01); *F28F 1/40* (2013.01); *F24H 1/205* (2013.01); *F28D 2021/0024* (2013.01); *F28F 2215/10* (2013.01)

(58) Field of Classification Search
CPC ..... F28D 2021/0024; F28F 1/40; F28F 13/12; F28F 2215/10
USPC ..... 122/13.01
See application file for complete search history.

(56) References Cited

U.S. PATENT DOCUMENTS

| | | | | |
|---|---|---|---|---|
| 6,070,657 | A * | 6/2000 | Kunkel | F28F 1/40 165/158 |
| 7,044,210 | B2 * | 5/2006 | Usui | F28F 1/40 165/177 |
| 2017/0138670 | A1 | 5/2017 | Penny et al. | |
| 2018/0271326 | A1 | 9/2018 | Buford et al. | |

FOREIGN PATENT DOCUMENTS

| | | | |
|---|---|---|---|
| DE | 29804225 | U1 | 7/1999 |
| JP | 2004317060 | A | 11/2004 |
| WO | 9949268 | A1 | 9/1999 |

OTHER PUBLICATIONS

European Communicatian pursuant to Article 94(3) for European Application No. 20 747 317.4, dated Nov. 17, 2022, 4 pages.
International Preliminary Report on Patentability and Written Opinion for International Application No. PCT/US2020/042096, issued Jan. 18, 2022, 7 pages.
European Communication pursuant to Article 94(3) for European Application No. 20 747 317.4, dated Aug. 24, 2023, 5 pages.

* cited by examiner

Lanced baffle

Straight fin Al baffle

Serpentine shaped fin Al baffle with flue core

Lanced baffle

Straight fin Al baffle

Serpentine shaped fin Al baffle with flue core

HEAT EXCHANGER BAFFLES AND METHODS FOR MANUFACTURING THE SAME

CROSS-REFERENCE TO RELATED APPLICATIONS

The present application is a National Stage application of PCT/US2020/042096, filed Jul. 15, 2020 which claims priority to U.S. Patent Application No. 62/874,574, filed Jul. 16, 2019, entitled "HEAT EXCHANGER BAFFLES AND METHODS FOR MANUFACTURING THE SAME," the contents of which are incorporated herein by reference in their entirety.

FIELD OF THE INVENTION

The disclosed subject matter relates generally to baffles for heat exchangers, and more particularly, to removable baffles for insertion in flue tubes of water heaters.

BACKGROUND OF THE INVENTION

Conventionally, water heaters are employed (e.g., installed in one or more buildings) to generate and maintain a readily usable source of hot water (e.g., to be used by a building's occupants). To generate the heat for heating the water, water heaters receive a source of energy, such as electricity or fuel such as oil or natural gas, which is consumed by a burner to heat the water. The burner creates hot exhaust gases, which may be vented through flue tubes passing through a water tank of the water heater. These flue tubes may include baffles designed to create a higher temperature gradient near the flue wall and to enhance the level of turbulence, thereby increasing the efficiency of the water heater.

There remains a need for improvements in heat exchanger baffles in terms of at least one of heat exchange performance, cost, and manufacturability.

SUMMARY OF THE INVENTION

The subject matter disclosed herein is directed to water heaters, baffles for water heaters, and methods for manufacturing such baffles.

In one example, a baffle includes a core, an outer wall, and a plurality of fins. The outer wall surrounds the core and defines at least one flow path between the outer wall and the core. The fins extend from the outer wall toward the core. Each of the plurality of fins has a serpentine shape.

In another example, a method for manufacturing a baffle includes extruding at least one portion of the baffle in one piece, the at least one portion of the baffle having an at least partially cylindrical outer wall and a plurality of fins extending inward from the outer wall, each of the plurality of fins having a serpentine shape.

In yet another example, a baffle includes a cylindrical core, an at least partially cylindrical outer wall, and a plurality of fins. The cylindrical core extends in an axial direction. The at least partially cylindrical outer wall surrounds the core and defines at least one flow path between the outer wall and the core. The fins extend from the outer wall to the core. Each of the plurality of fins has a serpentine shape and extends in a direction parallel to the axial direction. The outer wall and the plurality of fins are formed in one piece from extruded aluminum. An outer surface of the outer wall includes a plurality of indents in positions corresponding to the plurality of fins.

In still another example, a baffle includes a cylindrical core, an at least partially cylindrical outer wall, a plurality of first fins, and a plurality of second fins. The cylindrical core extends in an axial direction. The core has an at least partially serrated surface. The at least partially cylindrical outer wall surrounds the core and defines at least one flow path between the outer wall and the core. The outer wall has an at least partially serrated inner surface. The plurality of first fins extend from the outer wall to the core. The plurality of second fins extend from the outer wall and stop short of the core. Each of the plurality of first and second fins has a serpentine shape and extends in a direction parallel to the axial direction. The core, the outer wall, and the plurality of fins are formed in one piece from extruded aluminum. Each of the plurality of first fins has a thickened end segment where the fin contacts the core. Each of the plurality of first and second fins has a thickened base segment where the fin contacts the outer wall.

In yet another example, a water heating system includes a burner, a vent, at least one flue tube, and at least one baffle. The burner is configured to create products of combustion. The vent is configured to vent the products of combustion from the water heater. The at least one flue tube provides a flow path for the products of combustion from the burner to the vent. The at least one baffle is removably positioned within the at least one flue tube. The at least one baffle includes a core, an outer wall, and a plurality of fins. The outer wall surrounds the core and defines at least one flow path between the outer wall and the core. The fins extend from the outer wall toward the core. Each of the plurality of fins has a serpentine shape.

BRIEF DESCRIPTION OF THE DRAWINGS

The following detailed description is best understood when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. This emphasizes that according to common practice, the various features of the drawings are not drawn to scale unless otherwise indicated. On the contrary, the dimensions of the various features may be expanded or reduced for clarity. Included in the drawings are the following figures.

DETAILED DESCRIPTION OF THE INVENTION

Aspects of the disclosed subject matter relate to baffling in heat exchangers. The disclosed baffles may provide improvements in efficiency of heat exchangers. Such improvements may be created, for example, due to the creation of higher temperature gradients near flue walls, an increase in the level of turbulence of gasses flowing through flue tubes, an improved flow path through a heat exchanger, improved heat flow or transfer through the baffle material, improvements in latent heat transfer by enhancing the formation and drainage of water droplets/condensate for any condensing exhaust gases, or improvements in the cost and/or resources associated with producing, manufacturing, installing, or operating heat exchangers.

The subject matter disclosed herein is described primarily with respect to water heaters and water heating systems. However, it will be understood that the scope of this disclosure is not so limited. The subject matter of this disclosure is applicable to any type or variety of heat exchanger, including any heat exchanger designed to exchange heat between a flow of gas and a fluid (gas or liquid). In particular, this disclosure is not limited to devices for heating water (i.e. $H_2O$). As used herein, the terms "water heater" and "water heating" are intended to encompass any system, device, or method adapted to generate and maintain a source of heated fluid.

The subject matter disclosed herein is described primarily with respect to separate inserts, which may be installed in existing compartments or tubes of a water heater. However, it will be understood that the scope of this disclosure is not so limited. The disclosed baffles may be formed as inserts which may be installed into an existing flue tube or heat exchanger, or may be manufactured as integral or unitary parts of a flue tube or heat exchanger. The separate baffle inserts described herein may provide particular advantages with respect to ease of manufacture and installation.

Figure 1:
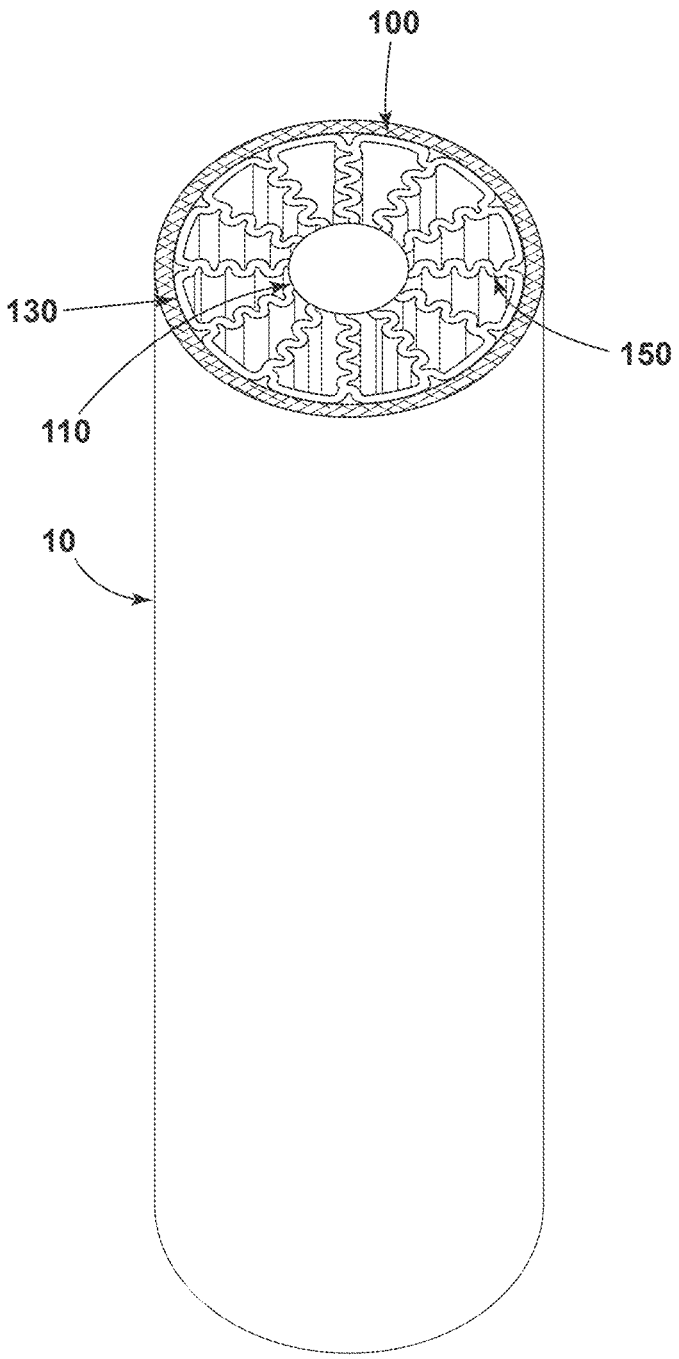
FIG. 1 is a perspective view of an example of a baffle inserted in a flue tube.
Figure 2:
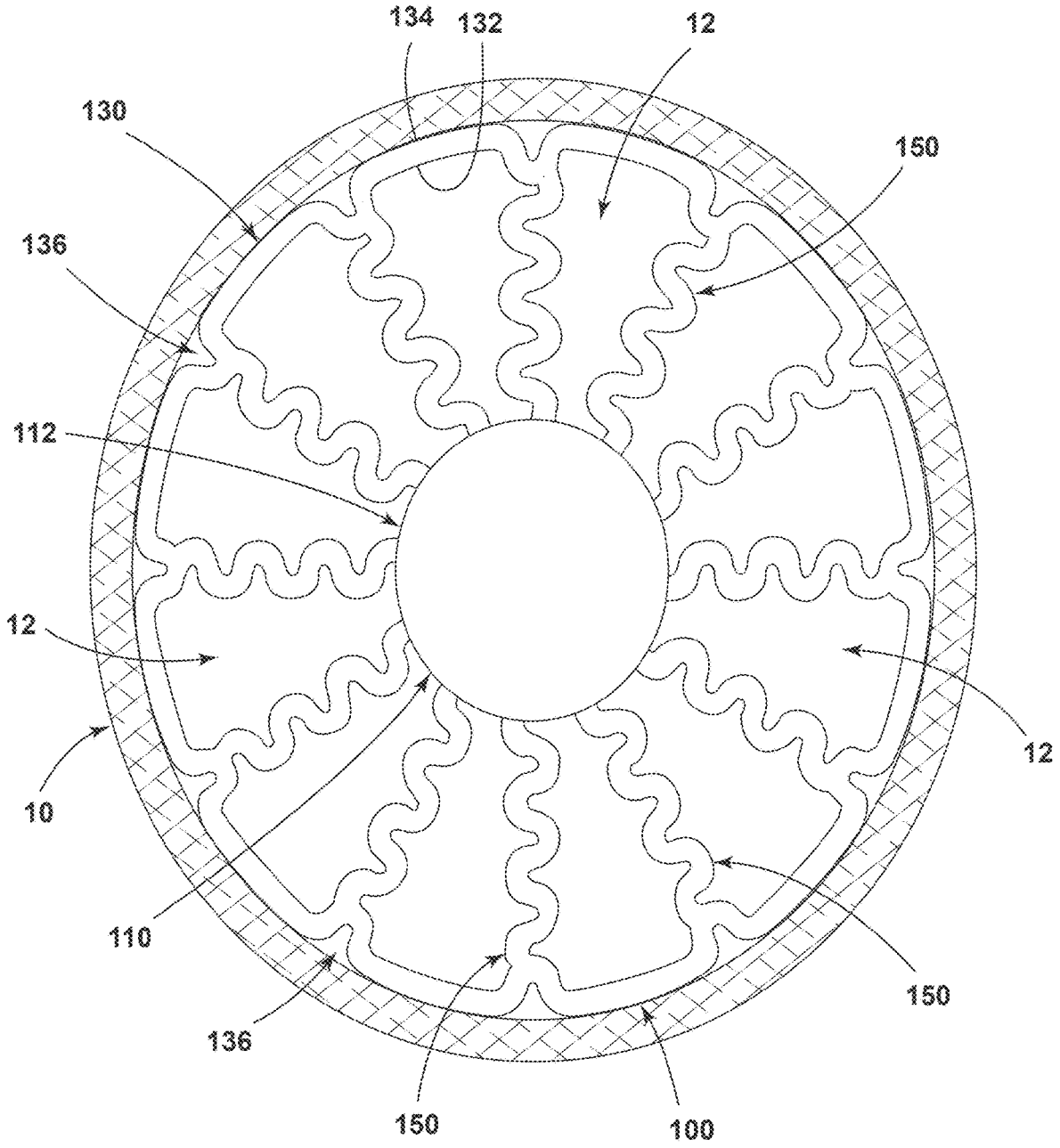
FIG. 2 is a cross-sectional view of the baffle and flue tube of FIG. 1.
Figure 3:
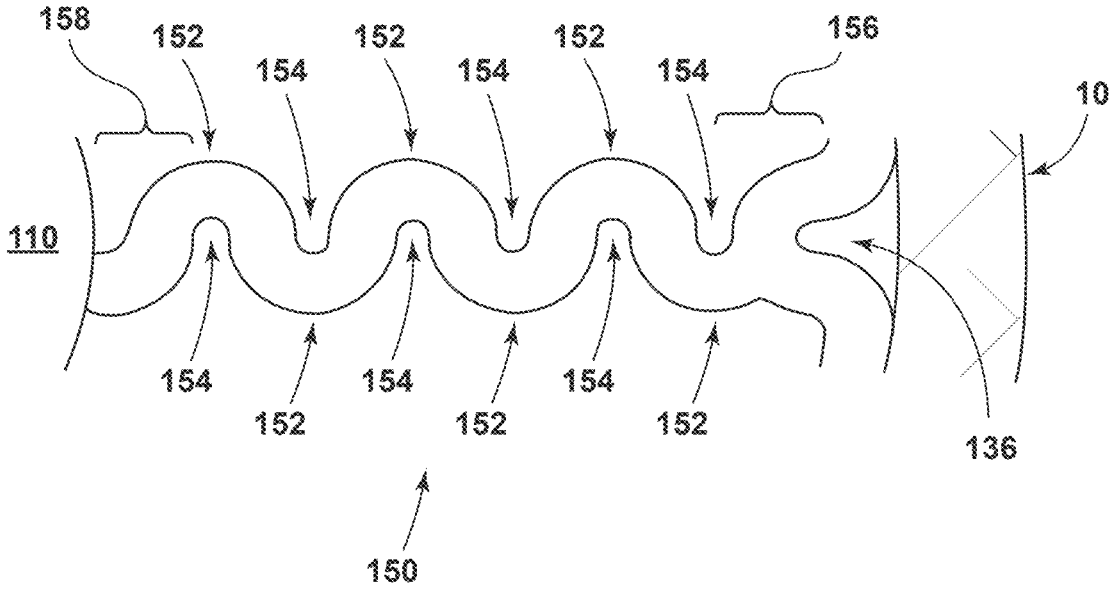
FIG. 3 is an enlarged cross-sectional view of a fin of the baffle of FIG. 1.

Referring now to the drawings, FIGS. 1-3 illustrate an example baffle 100. Baffle 100 is depicted inserted in a flue tube 10. Baffle 100 may be inserted in flue tube 10 of a water heater in order to increase water heater efficiency by promoting heat transfer between a hot gas passing through the flue tube and the wall of the flue tube. As a general overview, baffle has a core 110, an outer wall 130, and fins 150. Additional details of baffle 100 are described below.

Core 110 forms the center of baffle 100. Core 110 extends axially through baffle 100. Core 110 is positioned to extend along or adjacent the axial center of flue tube 10 when baffle 100 is inserted in flue tube 10. Core 110 may provide structural support for fins 150. Core 110 may likewise prevent shoot-through of hot gases through baffle 100, and thereby prevent poor heat transfer to the fins and consequently the flue tube walls.

Core 110 may have a size and shape dependent on the size and shape of the flue tube for which baffle 100 is intended. Core 110 may have a cylindrical shape, as shown in FIGS. 1 and 2. Alternatively, core 110 may have any shape selected based on the desired manufacturing process or desired heat exchange capabilities of core 110. Core 110 may have a radius of from one quarter to one half of the radius of baffle 100.

Figure 5:
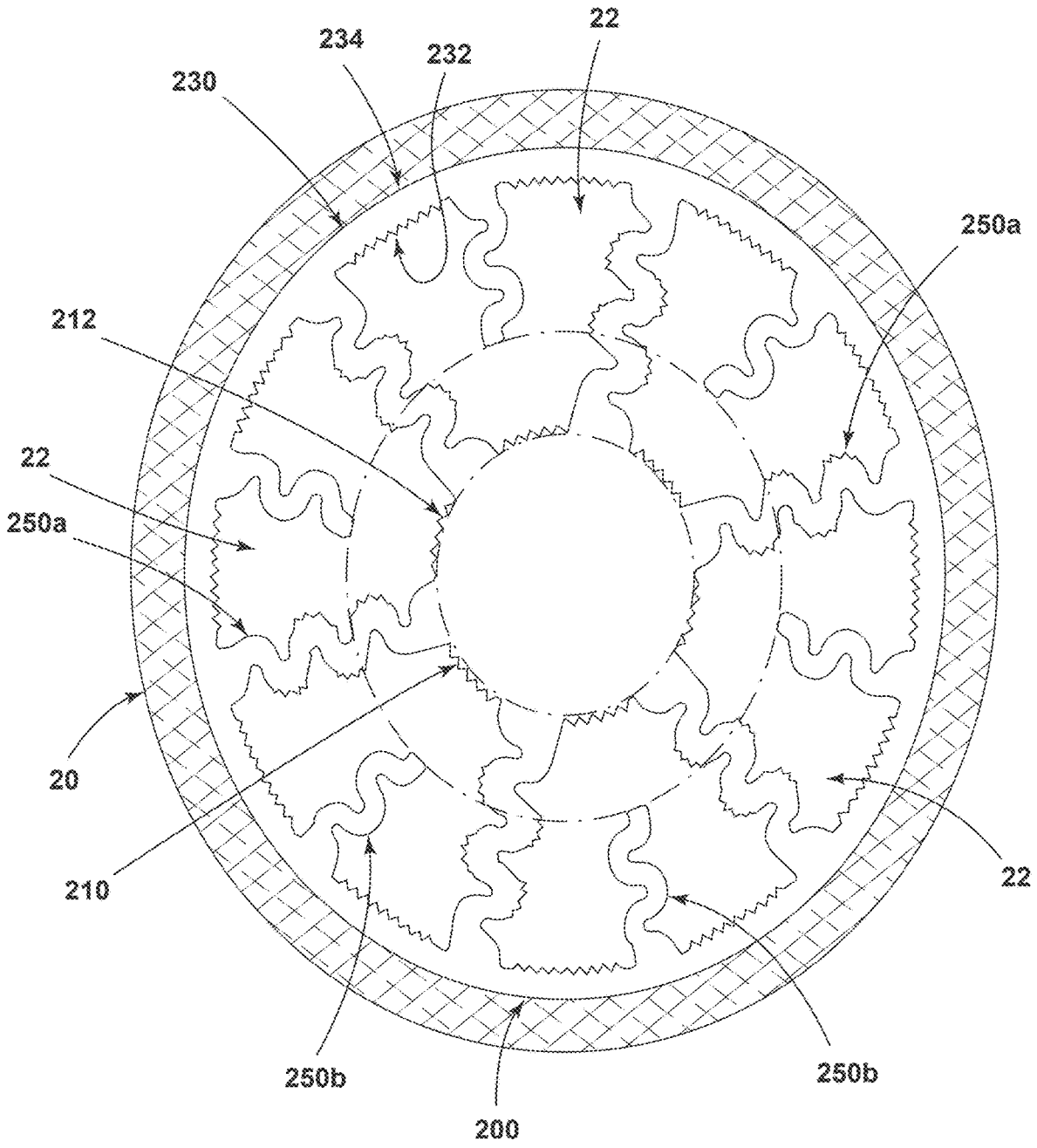
FIG. 5 is a cross-sectional view of the baffle and flue tube of FIG. 4.

Core 110 has a surface 112, as shown in FIG. 2. Surface 112 may be substantially smooth and circular, as shown in FIG. 2. Alternatively, at least a portion of surface 112 may include serrations, as shown in FIG. 5. Serrations may be formed as small aberrations, projections, points, undulations, protrusions, contours, or other deviations from a flat or planar surface on surface 112. Serrations may have a height of no more than 10% of the thickness of wall 130. Some or all of surface 112 may be serrated, as desired.

Outer wall 130 surrounds core 110. Outer wall 130 extends axially parallel to core 110. Outer wall 130 (in conjunction with core 110 and fins 150) defines at least one flow path for the passage of hot gases through flue tube 10. As shown in FIG. 2, core 110, outer wall 130, and fins 150 define twelve separate flow paths 12 through flue tube 10.

Outer wall 130 may have a size and shape dependent on the size and shape of the flue tube for which baffle 100 is intended. As shown in FIG. 2, outer wall 130 is sized and dimensioned to contact the inner wall of flue tube 10 when baffle 100 is inserted in flue tube 10. Outer wall 130 may be at least partially cylindrical, as shown in FIGS. 1 and 2. Alternatively, outer wall 130 may have any shape selected based on the desired manufacturing process or desired heat exchange capabilities of outer wall 130. Outer wall 130 may have a radius of from 0.5 in. to 2.5 in. Outer wall 130 may have a thickness of from 0.05 in. to 0.125 in.

Outer wall 130 has an inner surface 132, as shown in FIG. 2. Surface 132 may be substantially smooth and circular, as shown in FIG. 2. Alternatively, at least a portion of surface 132 may include serrations, as shown in FIG. 5. Serrations may be formed in the same manner recited above for surface 112. Some or all of surface 132 may be serrated, as desired, such that the surface 132 defines peaks and/or valleys extending in a direction along the length of the baffle.

Outer wall 130 has an outer surface 134, as shown in FIG. 2. All or substantially all of outer surface 134 may contact the inner wall of flue tube 10, in order to promote heat exchange between baffle 100 and flue tube 10. As shown in FIG. 2, outer surface 134 may include indents 136 in positions corresponding to the location of each fin 150. Indents 136 extend in the axial direction along outer surface 134. Indents 136 may be provided to simplify manufacturing of baffle 100, to simplify insertion and/or installation of baffle 100 in flue tube 10, to provide structural support or stability for fins 150, or for other reasons.

Fins 150 extend inwardly from outer wall 130 toward core 110. Fins 150 extend axially through baffle 100 in a direction parallel to the axial direction of core 110. Fins 150 (in conjunction with core 110 and outer wall 130) define at least one flow path for the passage of hot gases through flue tube 10. As shown in FIG. 2, core 110, outer wall 130, and fins 150 define twelve separate flow paths 12 through flue tube 10.

Fins 150 each have a serpentine shape. As used herein, the term "serpentine shape" means a curving or undulating shape forming alternating convex peaks, such as round convex peaks 152, and concave valleys, such as round concave valleys 154, with those alternating peaks and valleys being mirrored on opposed sides of the fin (such that the location of a convex peak on one side of the fin corresponds to the location of a concave valley on the immediate opposite side of the fin). The serpentine design, compared to straight fins, provides a higher heat transfer surface area, a larger blocked cross section, and an enhanced level of turbulence for products of combustion flowing adjacent the fins. The serpentine design also promotes water droplet formation in any condensing exhaust gases/water heaters by lowering surface tension in the concave valleys.

As shown in FIGS. 2 and 3, at least a majority of each fin 150, corresponding to at least the middle segment of each fin, has the serpentine shape. In fins 150, the convex peaks 152 may have a radius of curvature of from 0.03 in. to 0.15 in., and the concave valleys 154 may have a radius of curvature of from 0.005 in. to 0.025 in.

Fins 150 may all extend to and contact core 110, as shown in FIG. 2. Alternatively, one or more of fins 150 may not extend to core 110, e.g., may terminate prior to contacting core 110. In some examples, fins 150 may alternate between contacting core 110 and not contacting core 110 proceeding circumferentially around baffle 100.

Fins 150 have a base segment 156 where fins 150 extend from outer wall 130, and an end segment 158 where fins 150 contact core 110, as shown in FIG. 3. As shown in FIG. 3, base segments 156 of fins 150 may be thicker than middle segments of fins 150. Alternatively or additionally, end segments 158 of fins 150 may be thicker than middle segments of fins 150, and may have the same or a different thickness as base segments 156. As shown in FIGS. 2 and 3, indents 136 may extend into or adjacent the region of base segment 156 of fins 150.

Core 110, outer wall 130, and fins 150 may be formed in one piece as a unitary structure, or may be formed as distinct pieces. As shown in FIG. 2, outer wall 130 and fins 150 are formed in one piece as a unitary structure, and core 110 is formed separately from outer wall 130 and fins 150. In this example, core 110 may be inserted into the region defined by the ends of fins 150. Core 110 may be held in place by a friction fit with the ends of fins 150. Core 110 may be formed in one piece from extruded aluminum, and outer wall 130 and fins 150 may be formed in one piece from extruded aluminum, as described in greater detail below.

Figure 4:
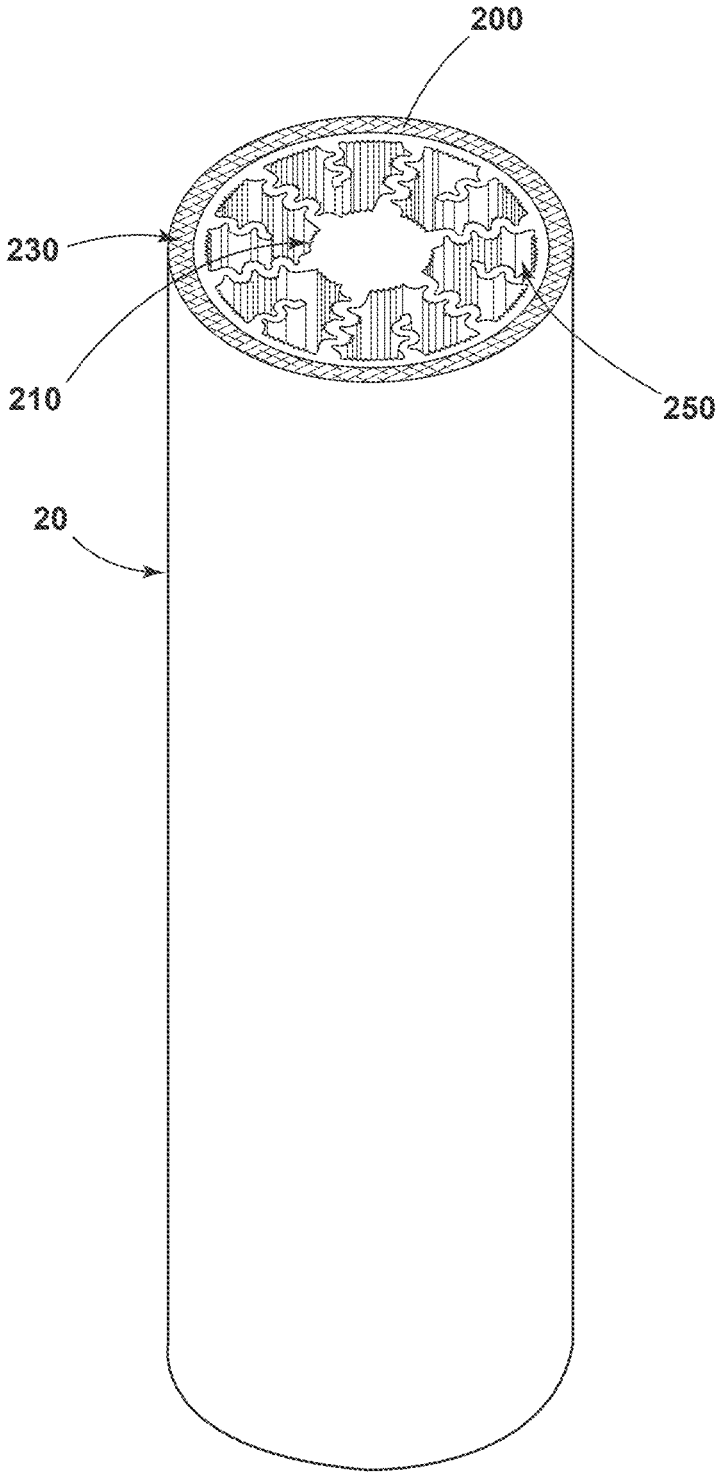
FIG. 4 is a perspective view of another example of a baffle inserted in a flue tube.
Figure 6:
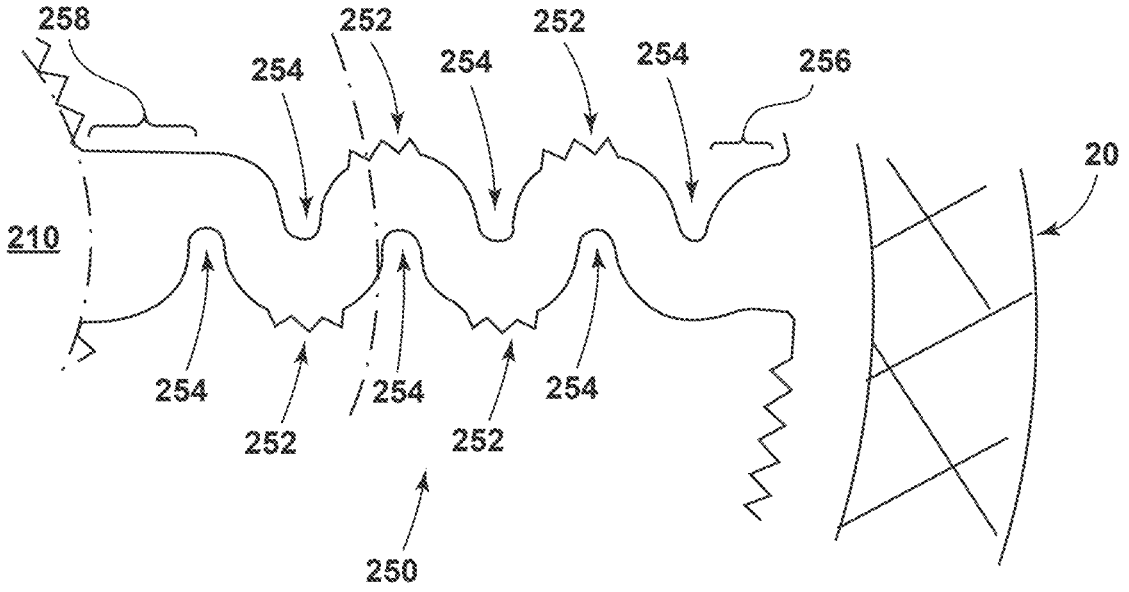
FIG. 6 is an enlarged cross-sectional view of a fin of the baffle of FIG. 4.

FIGS. 4-6 illustrate another example baffle 200. Baffle 200 is depicted inserted in a flue tube 20. Baffle 200 may be inserted in flue tube 20 of a water heater in order to increase water heater efficiency by promoting heat transfer between a hot gas passing through the flue tube and the wall of the flue tube. As a general overview, baffle has a core 210, an outer wall 230, and fins 250. Additional details of baffle 200 are described below.

Core 210 forms the center of baffle 200. Core 210 extends axially through baffle 200. Core 210 is positioned to extend along or adjacent the axial center of flue tube 20 when baffle 200 is inserted in flue tube 20. Core 210 may provide structural support for fins 250. Core 210 may likewise prevent shoot-through of hot gases through baffle 200, and thereby prevent poor heat transfer to the fins and consequently the flue tube walls.

Core 210 may have a size and shape dependent on the size and shape of the flue tube for which baffle 200 is intended. Core 210 may have a cylindrical shape, as shown in FIGS. 4 and 5. Alternatively, core 210 may have any shape selected based on the desired manufacturing process or desired heat exchange capabilities of core 210. Core 210 may have a radius of from one quarter to one half of the radius of baffle 200.

Core 210 has a surface 212, as shown in FIG. 5. Surface 212 may be substantially smooth and circular. Alternatively, as shown in FIG. 5, at least a portion, substantially ail, or all of surface 212 may include serrations. Serrations may be formed as small aberrations, projections, points, undulations, protrusions, contours, or other deviations from a flat or planar surface on surface 212. Serrations may have a height of no more than 10% of the thickness of wall 230. Some or all of surface 212 may be serrated, as desired.

Outer wall 230 surrounds core 210. Outer wall 230 extends axially parallel to core 210. Outer wall 230 (in conjunction with core 210 and fins 250) defines at least one flow path for the passage of hot gases through flue tube 20. As shown in FIG. 5, core 210, outer wall 230, and fins 250 define six separate flow paths 22 through flue tube 20.

Outer wall 230 may have a size and shape dependent on the size and shape of the flue tube for which baffle 200 is intended. As shown in FIG. 5, outer wall 230 is sized and dimensioned to contact the inner wall of flue tube 20 when baffle 200 is inserted in flue tube 20. Outer wall 230 may be at least partially cylindrical, substantially entirely cylindrical, or entirely cylindrical, as shown in FIGS. 4 and 5. Alternatively, outer wall 230 may have any shape selected based on the desired manufacturing process or desired heat exchange capabilities of outer wall 230. Outer wall 230 may have a radius of from 0.5 in. to 2.5 in. Outer wall 230 may have a thickness of from 0.05 in. to 0.125 in.

Outer wall 230 has an inner surface 232, as shown in FIG. 5. Surface 232 may be substantially smooth and circular. Alternatively, as shown in FIG. 5, at least a portion, substantially all, or all of surface 232 may include serrations. Serrations may be formed in the same manner recited above for surface 212. Some or all of surface 232 may be serrated, as desired.

Outer wall 230 has an outer surface 234, as shown in FIG. 5. All or substantially all of outer surface 234 may contact the inner wall of flue tube 20, in order to promote heat exchange between baffle 200 and flue tube 20, as shown in FIG. 5. Outer surface 234 may include indents in positions corresponding to the location of each fin 250, substantially as described above with respect to indents 136.

Fins 250 extend inwardly from outer wall 230 toward core 210. Fins 250 extend axially through baffle 200 in a direction parallel to the axial direction of core 210. Fins 250 (in conjunction with core 210 and outer wall 230) define at least one flow path for the passage of hot gases through flue tube 20. As shown in FIG. 5, core 210, outer wall 230, and fins 250 define six separate flow paths 22 through flue tube 20.

Fins 250 each have a serpentine shape, as that term is described earlier herein. Fins 250 include convex peaks 252 and round concave valleys 254. In fins 250, the convex peaks 252 may have a radius of curvature of from 0.03 in. to 0.15 in., and the concave valleys 254 may have a radius of curvature of from 0.005 in. to 0.025 in.

Fins 250 may all extend to and contact core 210, or may not extend to core 210, e.g., may terminate prior to contacting core 210. In one example, baffle 200 includes two sets of fins 250: fins **250*a* and fins 250*b*. Fins 250*a* extend to and contact core 210. Fins 250*b* terminate prior to contacting core 210, and do not contact core 210. As shown in FIGS. 4 and 5, fins 250*a* and 250*b* alternate proceeding circumferentially around baffle 200**.

Fins 250 have a base segment 256 where fins 250 extend from outer wall 230, and an end segment 258 where fins 250 contact core 210 or terminate before contacting core 210, as shown in FIG. 6. As shown in FIG. 6, base segments 256 of fins **250*a* and 250*b* are thicker than middle segments of fins 250*a* and 250*b*. Additionally, end segments 258 of fins 250*a* are thicker than middle segments of fins 250*a*, and may have the same or a different thickness as base segments 256**.

Core 210, outer wall 230, and fins 250 may be formed in one piece as a unitary structure, or may be formed as distinct pieces. As shown in FIG. 5, core 210, outer wall 230, and fins 250 are all formed in one piece as a unitary structure. In this example, core 110 may be inserted into the region defined by the ends of fins 150. Core 210, outer wall 230, and fins 250 may be formed in one piece from extruded aluminum, as described in greater detail below.

Figure 11:
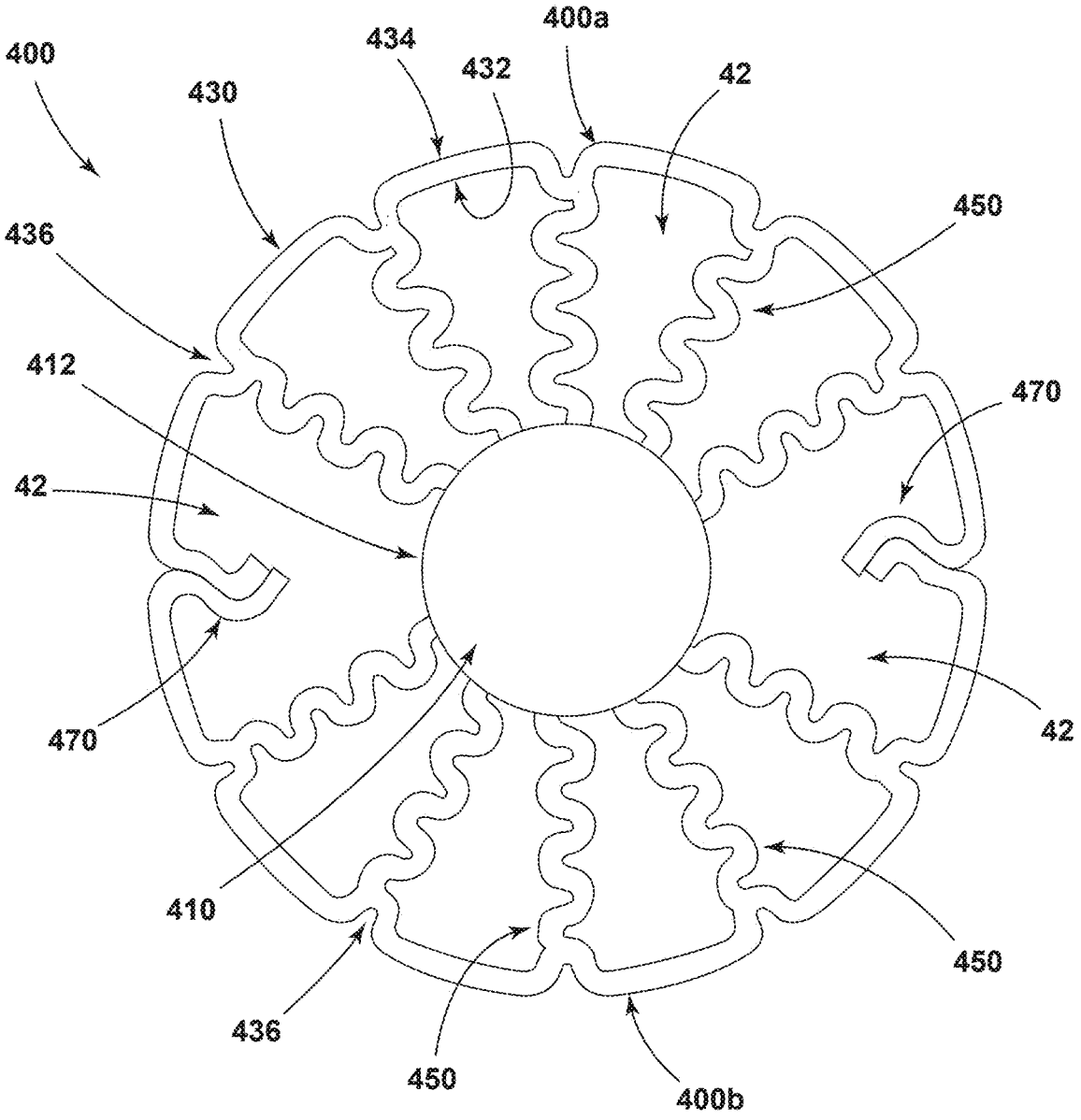
FIG. 11 is a cross-sectional view of another example baffle formed from baffle halves.
Figure 12:
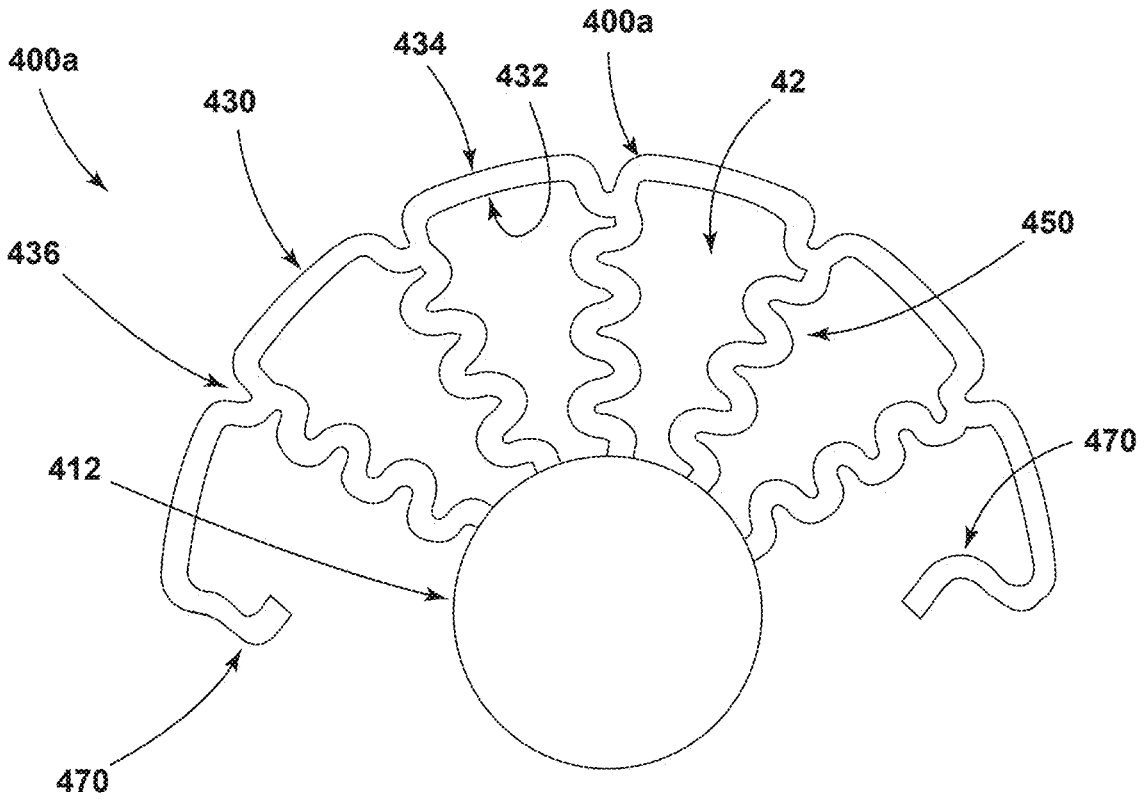
FIG. 12 is a cross-sectional view of one of the baffle halves of the baffle of FIG. 11.

FIGS. 11 and 12 illustrate another example baffle 400. Baffle 400 is configured to be inserted in a flue tube. Baffle 400 may be inserted in a flue tube of a water heater in order to increase water heater efficiency by promoting heat transfer between a hot gas passing through the flue tube and the wall of the flue tube. As a general overview, baffle has a core 410, an outer wall 430, and fins 450. Additional details of baffle 400 are described below.

Core 410 forms the center of baffle 400. Core 410 extends axially through baffle 400. Core 410 is positioned to extend along or adjacent the axial center of the flue tube when baffle 400 is inserted in the flue tube. Core 410 may provide structural support for fins 450. Core 410 may likewise prevent shoot-through of hot gases through baffle 400, and thereby prevent poor heat transfer to the fins and consequently the flue tube walls.

Core 410 may have a size and shape dependent on the size and shape of the flue tube for which baffle 400 is intended. Core 410 may have a cylindrical shape, as shown in FIGS. 11 and 12. Alternatively, core 410 may have any shape selected based on the desired manufacturing process or desired heat exchange capabilities of core 410. Core 410 may have a radius of from one quarter to one half of the radius of baffle 400.

Core 410 has a surface 412, as shown in FIG. 11. Surface 412 may be substantially smooth and circular. Alternatively, at least a portion, substantially all, or all of surface 412 may include serrations. Serrations may be formed as small aberrations, projections, points, undulations, protrusions, contours, or other deviations from a flat or planar surface on surface 412. Serrations may have a height of no more than 10% of the thickness of wall 430. Some or all of surface 412 may be serrated, as desired.

Outer wall 430 surrounds core 410. Outer wall 430 extends axially parallel to core 410. Outer wall 430 (in conjunction with core 410 and fins 450) defines at least one flow path for the passage of hot gases through a flue tube. As shown in FIG. 11, core 410, outer wall 430, and fins 450 define ten separate flow paths 42.

Outer wall 430 may have a size and shape dependent on the size and shape of the flue tube for which baffle 400 is intended. As shown in FIG. 11, outer wall 430 is sized and dimensioned to contact the inner wall of a flue tube when baffle 400 is inserted in a flue tube. Outer wall 430 may be at least partially cylindrical, substantially entirely cylindrical, or entirely cylindrical, as shown in FIG. 11. Alternatively, outer wall 430 may have any shape selected based on the desired manufacturing process or desired heat exchange capabilities of outer wall 430. Outer wall 430 may have a radius of from 0.5 in. to 2.5 in. Outer wall 430 may have a thickness of from 0.05 in. to 0.125 in.

Outer wall 430 has an inner surface 432, as shown in FIG. 11. Surface 432 may be substantially smooth and circular. Alternatively, at least a portion, substantially all, or all of surface 432 may include serrations. Serrations may be formed in the same manner recited above for surface 412. Some or all of surface 432 may be serrated, as desired.

Outer wall 430 has an outer surface 434, as shown in FIG. 11. All or substantially all of outer surface 434 may contact the inner wall of the flue tube, in order to promote heat exchange between baffle 400 and the flue tube. Outer surface 434 includes indents 436 in positions corresponding to the location of each fin 450, substantially as described above with respect to indents 136.

Fins 450 extend inwardly from outer wall 430 toward core 410. Fins 450 extend axially through baffle 400 in a direction parallel to the axial direction of core 410. Fins 450 (in conjunction with core 410 and outer wall 430) define at least one flow path for the passage of hot gases through the flue tube. As shown in FIG. 11, core 410, outer wall 430, and fins 450 define ten separate flow paths 42.

Fins 450 each have a serpentine shape, as that term is described earlier herein. Fins 450 may all extend to and contact core 410, as shown in FIG. 11. Alternatively, one or more of fins 450 may not extend to core 410, e.g., may terminate prior to contacting core 410. In some examples, fins 450 may alternate between contacting core 410 and not contacting core 410 proceeding circumferentially around baffle 400.

Fins 450 have a base segment where fins 450 extend from outer wall 430, and an end segment where fins 450 contact core 410, as shown in FIG. 11. The base and end segments of fins 450 may be substantially the same as those described above with respect to either baffle 100 and/or baffle 200.

In baffle 400, core 410, outer wall 430, and fins 450 are not formed in one piece. To the contrary, as shown in FIGS. 11 and 12, baffle 400 is formed in two half-baffle portions 400*a* and 400*b* which are assembled surrounding core 410. As shown in FIG. 12, each baffle portion 400*a* and 400*b* Includes half of outer wall 430, and half of the plurality of fins 450.

The formation of baffle 400 in multiple baffle portions 400*a* and 400*b* may simplify installation of baffle 400 in a flue tube. In a particular example, as shown in FIG. 11, baffle portions 400*a* and 400*b* have an identical structure, which may simplify manufacturing and installation of baffle 400. While baffle 400 is shown with two half-baffle portions 400*a* and 400*b*, it will be understood that baffle 400 may be formed including three, four, five, or any number of baffle portions which are designed to mate with one another to form the entire baffle 400.

Baffle portions 400*a* and 400*b* each include respective engagement surfaces 470. The engagement surfaces 470 of baffle portion 400*a* are configured to mate with the engagement surfaces 470 of baffle portion 400*b*, in order to form a complete baffle 400. The curved profile of engagement surfaces 470 provides flexibility to mate the two baffle portions 400*a* and 400*b* without compromising the required seal between products the combustion within the baffle and the inner surface of the flue tube. This makes insertion possible even when the flue tubes are not perfectly circular, or when the flue tube inner diameter tolerance is large. In addition, this design enables the baffle 400 to remain functional in the case of thermal contraction and expansion without losing its contact to the inner wall of the flue tube.

In an example manufacturing method, baffle 100 and/or baffle 200 and/or baffle 400 may be manufactured by extrusion. Suitable extrusion apparatus for use in manufacturing baffles 100 or 200 or 400 are known, and may include the use of industry standard extrusion processes similar to those used for commercially available aluminum rods. Details regarding the manufacture of an example baffle are described below with respect to the components of baffles 100 or 200 or 400. However, it will be understood that the disclosed manufacturing method may be used to manufacture other baffles than those expressly described herein.

Baffle 100 and/or baffle 200 and/or baffle 400 may be manufactured by extruding at least one portion of baffle 100 and/or baffle 200 and/or baffle 400 in one piece. Baffle 100 and/or baffle 200 and/or baffle 400 may be formed from extruded aluminum to promote heat transfer through conduction. Other high thermal conductivity materials for extruding baffle 100 and/or baffle 200 and/or baffle 400 are known, and may be selected based on their suitability for extrusion and/or for the heat transfer properties.

For baffle 100, a portion of the baffle having outer wall 130 and fins 150 may be extruded in one piece. Core 110 may then be separately manufactured (e.g., extruded), and friction fit between ends of fins 150 to complete baffle 100. Such friction fit may occur shortly following extrusion or at a later time, e.g., during installation of baffle 100 in flue tube 10. For baffle 200, the entire baffle, including core 210, outer wall 230, and fins 250 (including fins 250*a* and fins 250*b*) may be extruded in one piece. For baffle 400, each baffle portion 400*a* and 400*b* may be extruded in one piece.

As set forth above, surfaces of baffle 100 and/or baffle 200 and/or baffle 400 may include serrations. Forming baffle 100 and/or baffle 200 and/or baffle 400 may promote formation of baffle 100 and/or baffle 200 and/or baffle 400 with serrations may improve the manufacturability or improve the extrusion process. Moreover, serrations increase heat transfer surface area and promote turbulence at the wall by disturbing momentum and heat transfer boundary layers, thereby improving efficiency of the baffle.

Figure 7:
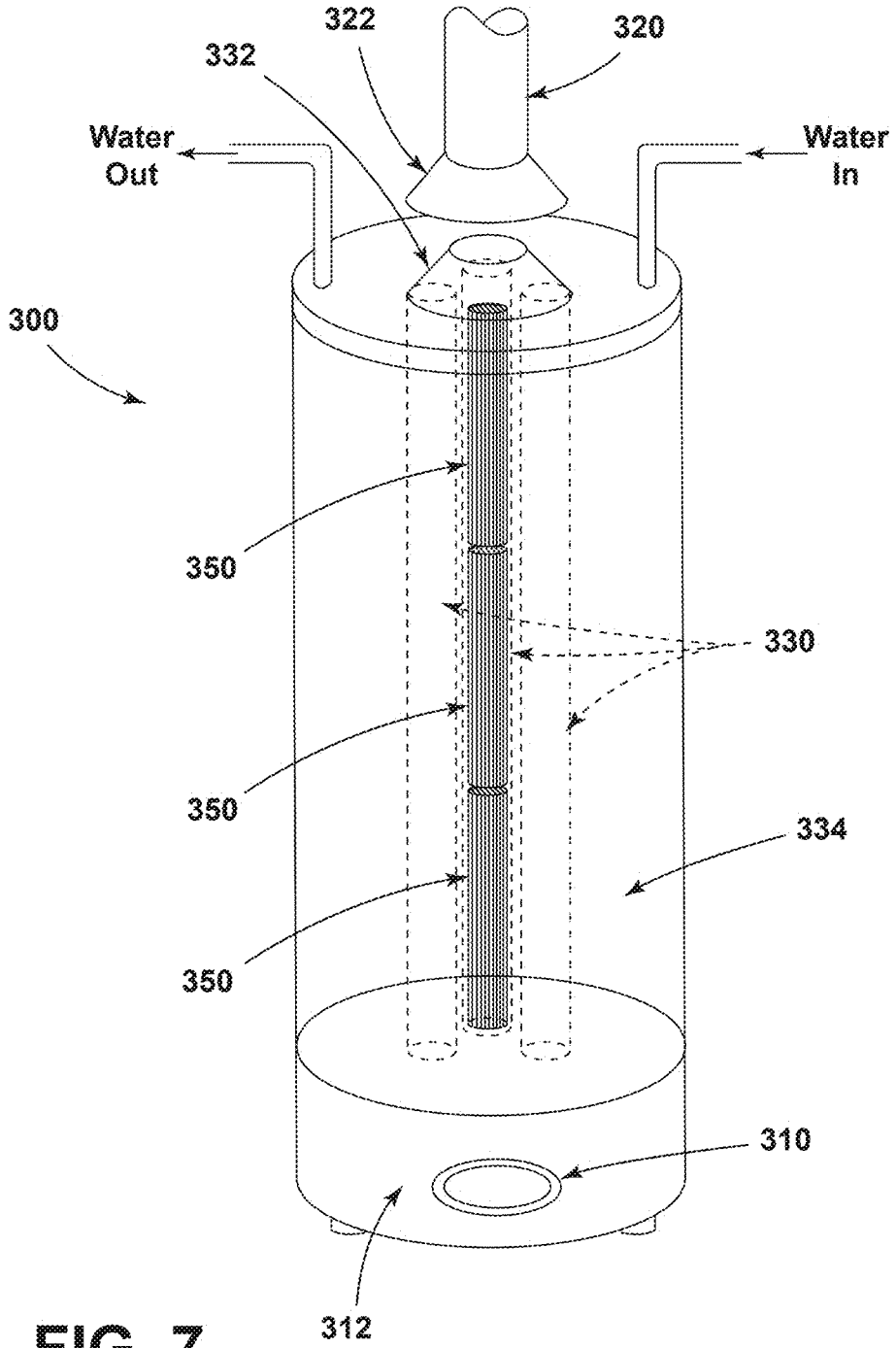
FIG. 7 is an example water heater containing a flue tube with a baffle.

FIG. 7 illustrates a water heating system 300. Water heating system 300 comprises a water heater having one or more baffles as described below, in order to increase water heater efficiency by promoting heat transfer between a hot gas passing through the water heater and water contained in the water heater. As a general overview, water heating system 300 has a burner 310, a vent 320, at least one flue tube 330, and at least one baffle 350. Additional details of water heating system 300 are described below.

Burner 310 burns fuel to create products of combustion. Burner 310 may burn, for example, natural gas. Suitable burners for use as burner 310 are known, and other suitable fuels for burning by burner 310 are known.

Burner 310 may be provided in a combustion chamber 312 having one or more air inlets for receiving air for combustion from outside of the water heater, and one or more air outlets for allowing hot gasses including the products of combustion to exist combustion chamber 312. Burner 310 and/or combustion chamber 312 may or may not be provided with a fan or blower for drawing in air to promote combustion or forcing hot gasses out to promote heating or efficiency of water heating system 300.

Vent 320 vents products of combustion from water heating system 300. Vent 320 is configured to receive hot gasses containing the products of combustion from burner 310 and/or combustion chamber 312. In one example, vent 320 comprises a draft hood 322. Draft hood 322 may be configured to allow the hot gasses containing the products of combustion to mix with ambient air surrounding the water heater while being vented from the water heater. It will be understood that in other examples, vent 320 may not include a draft hood.

Flue tubes 330 provide a flow path through the water heater for the products of combustion to pass from burner 310 to vent 320. As shown in FIG. 7, flue tubes 330 may empty Into a collector 332 prior to being vented from the water heater.

Flue tubes 330 pass through a water storage tank 334. As such, the outer surface of flue tubes 330 is positioned in contact with water in water storage tank 334, to promote heat transfer between the hot gasses passing through flue tubes 330 and the water. Flue tubes 330 may be the same as, or include any of the features of, flue tubes 10 and 20 described herein.

At least one baffle 350 is positioned within at least one of flue tubes 330. Baffle(s) 350 may be removable positioned within flue tube(s) 330. Baffle(s) 350 may be the same as, or include any of the features of, baffle 100 and/or baffle 200 and/or baffle 400.

As shown in FIG. 7, a plurality of baffles 350 may be provided in series in a single flue tube 330. Baffles 350 may be positioned in end-to-end contact with one another within a flue tube 330. Alternatively, baffles 350 may be spaced apart from one another. Baffles 350 may include an intervening space, or may include a separate intervening structure, in order to create space between one another. Baffles 350 may be held in position within flue tube 330, for example, by friction fit between an outer surface of baffles 350 and an inner surface of flue tubes 330. This friction fit may allow baffles to be easily removable for repair or replacement.

Baffles 350 may be identical, or may have different arrangements of fins and/or flow paths, as desired. In one example, baffles 350 have identical arrangements of fins, but are angularly offset or rotated relative to one another, such that the fins of one baffle 350 are not axially aligned within flue tube 330 with the fins of another baffle 350. Baffles 350 may be rotated relative to one another by a predetermined amount, e.g., each baffle 350 may be offset by 45° relative to the baffle above or below. This angular offset or rotation may advantageously promote turbulent flow of hot gasses through flue tube 330 and between baffles 350, and thereby promote efficient and improved heat transfer between the hot gasses passing through flue tube 330 and water contained in water storage tank 334.

EXAMPLES

Figure 8A:
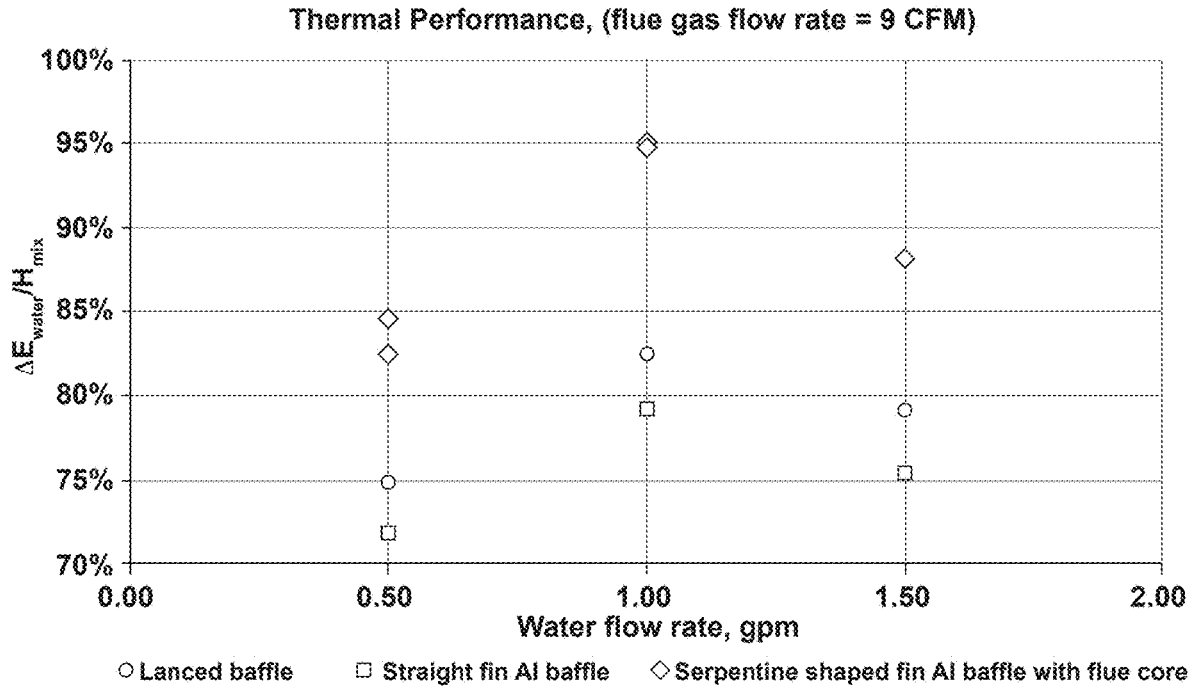
FIGS. 8A-8D and 9A-9D are graphs showing thermal performance and pressure drop for the depicted examples of baffles including the baffle of FIG. 1.
Figure 9A:
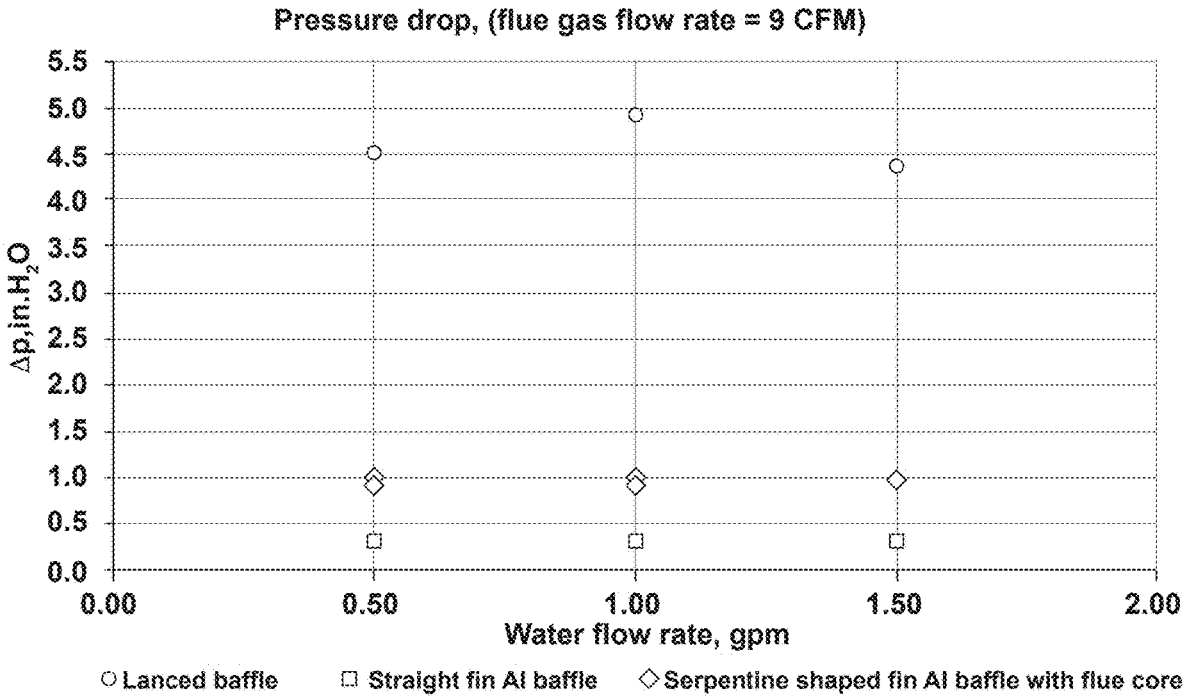

Examples of a baffle produced according to the disclosure herein have been prepared and tested for performance. FIG. 8A illustrates the results of testing of thermal performance for example baffles having serpentine fins and a central core as described above with respect to baffle 100. FIG. 9A illustrates the results of testing of pressure drop for example baffles having serpentine fins and a central core as described above with respect to baffle 100.

In the testing of FIGS. 8A and 9A, the example baffles depicted in FIGS. 8B-8D and 9B-9D were Installed in a heat exchanger (e.g., a water heater) having a single flue tube and tested at a flow rate of air of 9 cubic feet per minute (CFM). The single flue tube is arranged coaxially inside a cylindrical water tube. This set-up makes it possible to systematically compare various baffle types. Cold water at a certain temperature enters the lower section of the water tube at a range of flow rates and exits from the top section. Combustion gases from another exchanger located upstream are fed into the single tube exchanger at a specified temperature and flow rate. Inlet gas temperature and flow rate are adjusted to ensure that condensation occurs in the single tube exchanger. This is necessary to assess combined sensible and latent heat transfer capabilities of various baffle types.

The hot gases flow to the top and exit from the flue tube. Energy/enthalpy content of combustion gases is calculated by measuring flow rate, temperature and gas composition. Energy transferred to water flow is calculated by measuring flow rate and inlet and outlet temperatures.

Figure 8B:
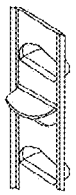
Figure 8C:
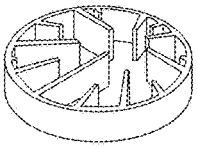
Figure 8D:
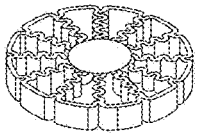
Figure 9B:
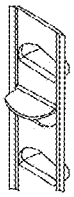
Figure 9C:
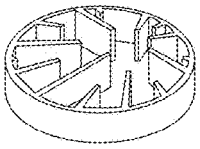
Figure 9D:
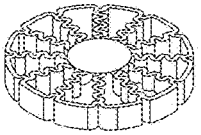

In the testing of FIGS. 8A and 9A, the performance of the example baffles in FIGS. 8D and 9D is compared to examples lacking the features described herein, including a lanced baffle as shown in FIGS. 8B and 9B and a baffle with straight, non-serpentine fines as shown in FIGS. 8C and 9C. The lanced baffle of FIGS. 8B and 9B is made from a rectangular metal strip which has multiple semicircular metal discs punched out and bent to be positioned transverse to the strip along the length of the flue tube. This type of baffle is known to create significant pressure drops as it impedes the gas flow. The straight baffle of FIGS. 8C and 9C is an aluminum baffle with straight, non-serpentine fins.

As shown in FIG. 8A, the example baffles produced according to the description of baffle 100 achieved a thermal performance significantly higher than the comparative examples: between 82-85% at a water flow rate of 0.5 gallons per minute (gpm); approximately 95% at a water flow rate of 1.0 gpm; and approximately 88% at a water flow rate of 1.5 gpm. The thermal performance of the single tube heat exchanger (water heater) is defined herein as the ratio of energy transferred to water to total energy/enthalpy of hot gases entering in the exchanger.

As shown in FIG. 9A, the example baffles produced according to the description of baffle 100 achieved a pressure drop significantly lower than the lanced baffle, and comparable to the straight fin baffle: at or below 1.0 in. $H_2O$ at water flow rates of 0.5, 1.0, and 1.5 gpm. Pressure drop is measured by placing two pressure tabs, one at the inlet and another at the outlet of the gas flue tube.

Figure 10:
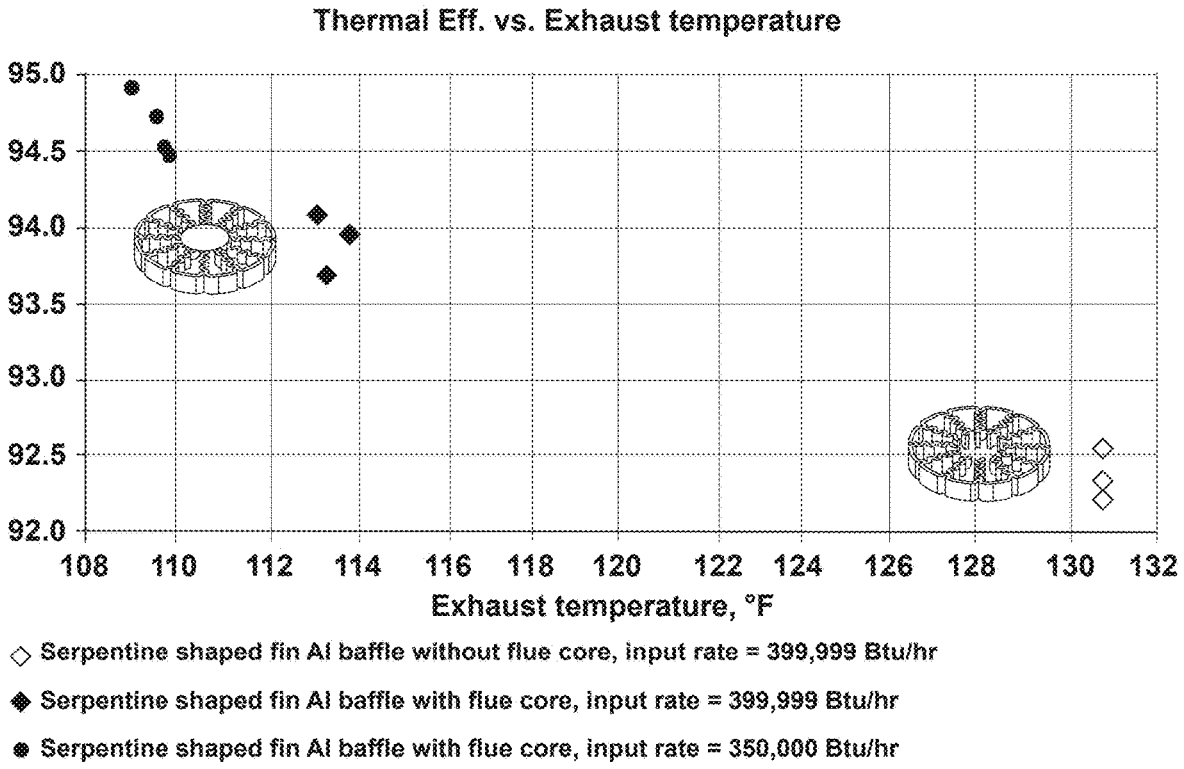
FIG. 10 is a graph showing thermal efficiency vs. exhaust temperature for the depicted examples of baffles including the baffle of FIG. 1.

FIG. 10 illustrates the results of testing of thermal efficiency vs. exhaust temperature for example baffles having serpentine fins and a central core as described above with respect to baffle 100. In the testing of FIG. 10, the example baffles were installed in a water heater having eight 2" flue tubes and tested at inputs of 350,000 Btu/hr and 399,999 Btu/hr. This set of testing uses a condensing high efficiency water heater currently manufactured and sold by Bradford White Corporation of Ambler, Pennsylvania. The gas flow path includes three vertical passes in communication with a premixed burner assembly. The first pass has a single 8" flue tube (top to bottom), the second pass (bottom to top) has two 4" flue tubes, and the third pass (top to bottom) has eight 2" flue tubes. Condensation occurs in the third pass. In this set of tests, currently used lanced baffles are replaced with examples of the baffles described herein. In the testing of FIG. 10, the performance of the example baffles is compared to examples lacking the features described herein, including baffles lacking a central core.

As shown in FIG. 10, the example baffles produced according to the description of baffle 100 achieved a thermal efficiency of between 93.5% and 95%, with correspondingly low exhaust temperatures of from 108° F. to 114° F. The calculation of thermal efficiency will be understood by those of ordinary skill in the art, and is described, for example, in American National Standards Institute (ANSI) Z21.10.3-2017.

FIG. 10 demonstrates that adding a flue core substantially increases thermal efficiency and decreases exhaust gas temperature, and that a decrease in the input rate increases thermal efficiency even further followed by a decrease in exhaust temperature. It will be understood that from the energy efficiency perspective, thermal efficiency values higher than 94% are of importance as such values may qualify the appliance for ENERGY STAR certification.

As shown by the test results of FIGS. 8A-10, the baffles described herein may be configured to achieve both significantly improved thermal performance/efficiency, while maintaining a limited pressure drop on gasses passing through the baffles and low exhaust gas temperatures.

Although the invention is illustrated and described herein with reference to specific embodiments, the Invention Is not intended to be limited to the details shown. Rather, various modifications may be made in the details within the scope and range of equivalents of the claims, and any combination of any features of any of the embodiments herein may be made, without departing from the invention.

What is claimed:

1. A baffle comprising:

a cylindrical core with a closed end;

an outer wall surrounding the core and defining at least one flow path between the outer wall and the core; and a plurality of fins extending from the outer wall toward the core, each of the plurality of fins having a serpentine shape having a curving or undulating shape forming a plurality of alternating convex peaks.

2. The baffle of claim 1, wherein the core has a surface, and wherein at least a portion of the surface of the core is serrated.

3. The baffle of claim 1, wherein the outer wall is at least partially cylindrical.

4. The baffle of claim 1, wherein the outer wall has an inner surface, and wherein at least a portion of the inner surface of the outer wall is serrated.

5. The baffle of claim 1, wherein the outer wall has an outer surface, and wherein the outer surface of the outer wall includes a plurality of indents in positions corresponding to the plurality of fins.

6. The baffle of claim 1, wherein all of the plurality of fins extend to the core.

7. The baffle of claim 1, wherein at least one of the plurality of fins extends to the core, and at least another one of the plurality of fins does not extend to the core.

8. The baffle of claim 7, wherein the at least one of the plurality of fins that extends to the core has a thickened segment where the fin contacts the core.

9. The baffle of claim 1, wherein the core extends in an axial direction, and wherein each of the plurality of fins extend in a direction parallel to the axial direction.

10. The baffle of claim 1, wherein the outer wall and the plurality of fins are formed from multiple baffle portions, each of the multiple baffle portions comprising at least a portion of the outer wall and at least one of the plurality of fins.

11. The baffle of claim 10, wherein the multiple baffle portions consist of two half-baffle portions.

12. The baffle of claim 10, wherein the multiple baffle portions have an identical structure.

13. The baffle of claim 10, wherein each one of the multiple baffle portions comprises an engagement surface configured to mate with an engagement surface of at least one other one of the multiple baffle portions.

14. A method for manufacturing a baffle, comprising:

extruding at least one portion of the baffle in one piece, the at least one portion of the baffle having an at least partially cylindrical outer wall and a plurality of fins extending inward from the outer wall to a common cylindrical core with a closed end, each of the plurality of fins having a serpentine shape having a curving or undulating shape forming a plurality of alternating convex peaks.

15. The method of claim 14, wherein the extruding comprises extruding in one piece from aluminum.

16. The method of claim 14, wherein the outer wall has an inner surface, and wherein at least a portion of the inner surface of the outer wall is serrated.

17. The method of claim 14, further comprising extruding the core separately from extruding the outer wall or the plurality of fins of the baffle.

18. The method of claim 14, wherein the extruding comprises extruding the entire baffle in multiple baffle portions, each of the multiple baffle portions comprising at least a portion of the at least partially cylindrical outer wall and at least one of the plurality of fins.

19. The method of claim 18, wherein the extruding comprising extruding exactly two half-baffle portions having an identical structure.

20. A baffle comprising:

a cylindrical core with a closed end extending in an axial direction;

an at least partially cylindrical outer wall surrounding the core and defining at least one flow path between the outer wall and the core; and a plurality of fins extending from the outer wall to the core, each of the plurality of fins having a serpentine shape having a curving or undulating shape forming a plurality of alternating convex peaks and extending in a direction parallel to the axial direction, wherein the outer wall and the plurality of fins are formed in one piece from extruded aluminum, and wherein an outer surface of the outer wall includes a plurality of indents in positions corresponding to the plurality of fins.

21. A water heating system comprising:

a burner configured to create products of combustion;

a vent configured to vent the products of combustion from the water heater;

at least one flue tube defining a flow path for the products of combustion received from the burner and extending toward the vent; and at least one baffle removably positioned within the at least one flue tube, the at least one baffle comprising:

a cylindrical core with a closed end;

an outer wall surrounding the core and defining at least one flow path between the outer wall and the core; and a plurality of fins extending from the outer wall toward the core, each of the plurality of fins having a serpentine shape having a curving or undulating shape forming a plurality of alternating convex peaks.

22. The water heater of claim 21, wherein the at least one baffle comprises a plurality of baffles positioned within the at least one flue tube.

23. The water heater of claim 22, wherein one of the plurality of baffles is angularly offset relative to another one of the plurality of baffles, such that the plurality of fins of the one of the plurality of baffles are not axially aligned with the plurality of fins of the other one of the plurality of baffles.

* * * * *